US006220192B1

(12) United States Patent
Kähler et al.

(10) Patent No.: US 6,220,192 B1
(45) Date of Patent: Apr. 24, 2001

(54) BUTTONHOLE SEWING MACHINE

(75) Inventors: Dietrich Kähler, Bielefeld; Jochen Fischer, Detmold, both of (DE)

(73) Assignee: Durkopp Adler Aktiengesellschaft (DE)

( * ) Notice: Subject to any disclaimer, the term of this patent is extended or adjusted under 35 U.S.C. 154(b) by 0 days.

(21) Appl. No.: 09/543,827

(22) Filed: Apr. 5, 2000

(30) Foreign Application Priority Data

Apr. 14, 1999 (DE) ..... 199 16 660

(51) Int. Cl.[7] ..... D05B 3/06; D05B 19/14; D05B 19/16

(52) U.S. Cl. ..... 112/68; 112/447; 112/470.04

(58) Field of Search ..... 112/68, 65, 66, 112/470.01, 470.04, 475.25, 447

(56) References Cited

U.S. PATENT DOCUMENTS 1,991,627 2/1935 Reece .
4,501,207 * 2/1985 Miyazaki et al. ..... 112/66
4,953,486 * 9/1990 Sano et al. ..... 112/447
6,006,685 * 12/1999 Kastrup et al. ..... 112/68

FOREIGN PATENT DOCUMENTS 1 208 167 12/1965 (DE) .
33 02 385 A1 8/1983 (DE) .
35 90 091 T1 9/1985 (DE) .

* cited by examiner

*Primary Examiner*—Peter Nerbun
(74) *Attorney, Agent, or Firm*—Robert F. I. Conte; Lee, Mann, Smith, McWilliams, Sweeney & Ohlson

(57) ABSTRACT

A buttonhole sewing machine for the production of a group of at least two buttonholes of varying design and/or size comprises devices for the entry, storage and processing of information on the varying design and/or size of the group of buttonholes and a device for triggering the drives for the successive production of buttonholes on the workpiece.

11 Claims, 5 Drawing Sheets

FIG. 1
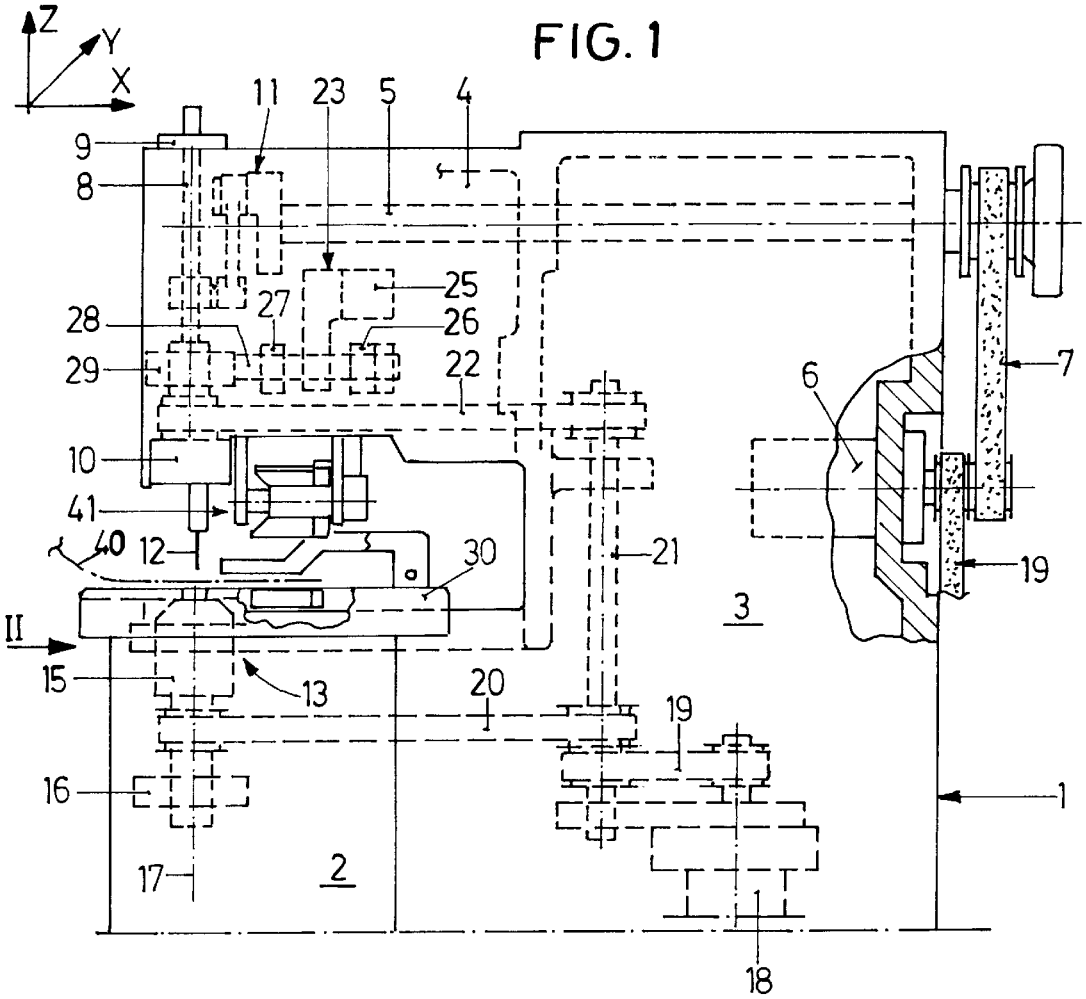
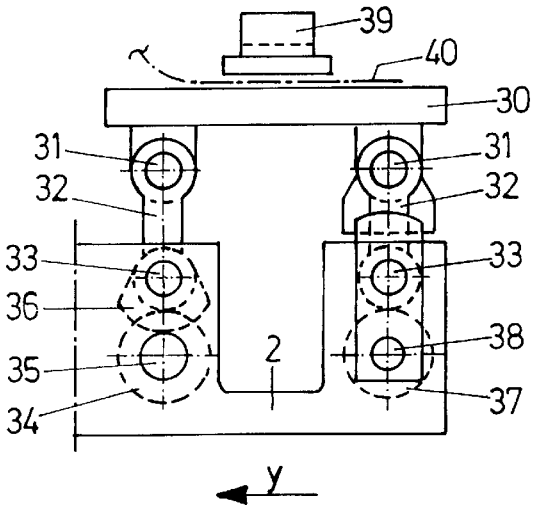
FIG. 2

FIG. 12

| PRG | 40 | | | |
|---|---|---|---|---|
| 76, 79, 83 | A | B | B | C |
| l (mm) | 16 | 20 | 20 | 12 |
| 105 | ⊗ | ⊗ | ⊗ | ⊗ |
| 50 | ⊗ | ⊗ | ⊗ | ○ |
| 102 | ○ | ⊗ | ⊗ | ⊗ |
| 106 | ⊘ | ⊗ | ⊗ | ○ |
| 109 | ○ | ⊗ | ⊗ | ○ |
| a (mm) | σ | 4 | 4 | σ |
| b (mm) | 2 | 3 | 3 | 2 |

BUTTONHOLE SEWING MACHINE

BACKGROUND OF THE INVENTION

1. Field of the Invention

The invention relates to a buttonhole sewing machine for the production of a group of buttonholes on a workpiece, the group having at least two buttonholes of varying design and/or size, the buttonhole sewing machine comprising a needle, which is mounted in an arm, and which is drivable to reciprocate in a Z direction by means of a driving motor, and which is drivable by a jogging drive for the production of a zigzag seam by a motion of the needle relative to the workpiece, and which is drivable to pivot about an axis by means of a pivot drive; a hook bearing, which is disposed in a base plate, and which is drivable by a pivot drive to pivot synchronously and equiangularly of the needle about a pivot axis which extends in the Z direction; a hook, which is disposed in the hook bearing; a stitch hole, which is allocated to the needle and the hook; a holder for the workpiece, which holder is displaceable by drives in an X direction and a Y direction; and an operating and control unit.

2. Background Art

In a buttonhole sewing machine of the generic type known from U.S. Ser. No. 09/063,965, U.S. Pat. No. 6,006,685 the workpiece holder in the form of an X-Y table is actuated by two stepper motors. Furthermore, the needle bar and the hook bearing are driven synchronously and equiangularly by a stepper motor so that the sewing tools are rotatable about the axis of the needle, which helps attain a constant position of the sewing tools relative to the direction of sewing and thus considerable flexibility of the machine as regards the geometry of the seam.

SUMMARY OF THE INVENTION

It is an object of the invention to embody the buttonhole sewing machine of the generic type such that a group of buttonholes of varying design and/or dimensions can be sewn by it successively, there being no need of manual adjustment of the machine.

According to the invention, this object is attained by devices for the entry, storage and processing of information about the varying design and/or size of the group of buttonholes; and by a device for triggering the drives for the successive production of the buttonholes on the workpiece. The measures according to the invention help attain that all the relevant parameters of buttonholes that are to be produced successively at a single work place, i.e. by one and the same buttonhole sewing machine, are entered in advance and that the buttonholes are then sewn one after the other. The buttonholes can be cut if a cutter is provided for the production of an incision in the zigzag seam; if the operating and control unit comprises means for the entry, storage and processing of information about the execution and non-execution and the type of the incision; and if the device for triggering the drives also comprises means for triggering the cutter. In this case it is of no importance whether cutting the buttonholes takes place in the pre- or after-cutting mode.

Provision is made for a gimp thread feeder, which is very often desired, automatic feeding and cutting of the gimp thread being provided within the scope of automation of the sewing operation of the varying buttonholes. Of course, this design of the gimp thread feeder can also be employed when buttonholes are sewn successively which are identical in design and size and/or when no automation is provided.

Details of the invention will become apparent from the ensuing description of an exemplary embodiment, taken in conjunction with the drawing.

BRIEF DESCRIPTION OF THE DRAWING

FIG. 1 is an elevation of a buttonhole sewing machine;

FIG. 2 is a front view of an X-Y table according to the arrow II of FIG. 1;

FIG. 12 is an input diagram for illustration of the entry of buttonhole parameters.

DESCRIPTION OF THE PREFERRED EMBODIMENT

Figure 3:
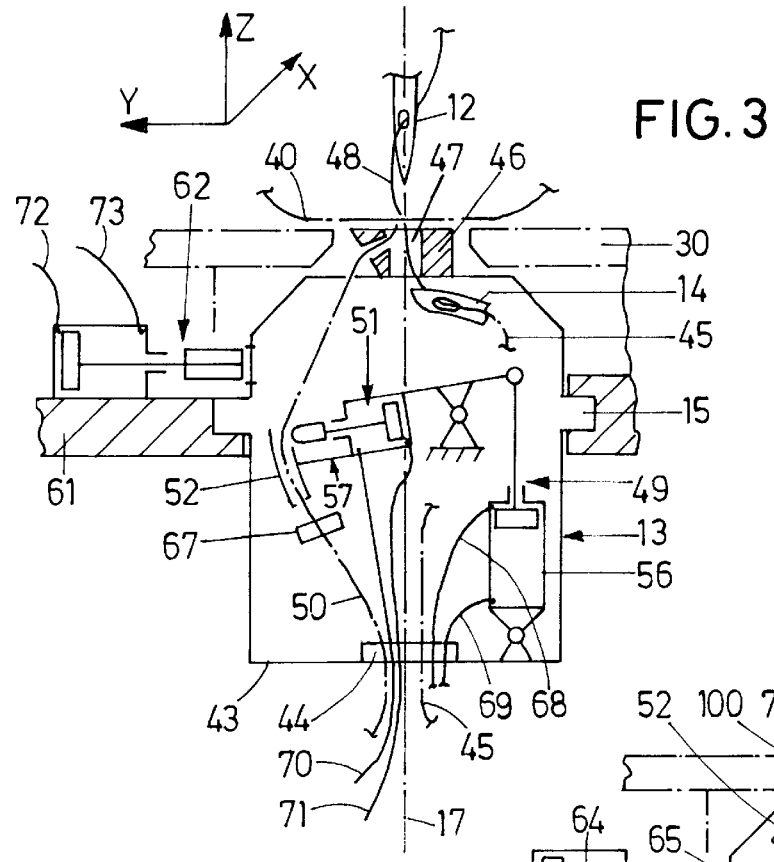
FIG. 3 is a diagrammatic illustration of a vertical section of a gimp thread feeder according to the arrow II of FIG. 1 during a sewing job.

The single/double thread chain stitch sewing machine seen in FIG. 1 comprises a housing 1, which substantially consists of a so-called base plate 2, a standard 3 and an upper arm 4. An arm shaft 5 is rotatably run in the arm 4 and can be driven in rotation by means of a driving motor 6 via a belt drive 7.

Mounted in the arm 4 in bearings 9, 10 is a substantially vertical needle bar 8, which can be driven to reciprocate by the arm shaft 5 via a crank drive 11. At its lower end, the needle bar 8 is provided with a needle 12.

Underneath the needle bar 8, a hook bearing 13, which comprises a chain stitch hook 14 (FIG. 3), is mounted in bearings 15, 16 for rotation by approximately 400° about a vertical pivot axis 17 which extends in the Z direction. Rotary actuation of the hook bearing 13 takes place via two belt drives 19, 20 by means of a stepper motor which serves as a pivot drive 18. The needle bar 8 is mounted in the bearings 9, 10 not only for displacement in the longitudinal direction, but also for rotation about the pivot axis 17. Via a setting shaft 21, which is drivable by the belt drive 19 and extends in the Z direction, and via a further belt drive 22, it is driven synchronously and equiangularly of the hook bearing 13 by the pivot drive 18 so that the needle 12 and the hook bearing 13 are synchronously and equiangularly pivoted about the pivot axis 17.

The needle bar 8 and the needle 12 are drivable to jog laterally, i.e. to swing, by means of a needle jogging drive 23. The lateral jogging motion is accompanied with a deflection of the needle bar 8 relative to the pivot axis 17. Due to the rotatability of the needle bar 8, the jogging plane of the needle bar 8 with the needle 12 is displaceable synchronously and equiangularly of the position of rotation of the hook bearing 13. A stepper motor 25 is provided for the lateral jogging of the needle bar 8, this stepper motor 25 acting on the needle bar 8 by way of a jogging shaft 28, which is run in bearings 26, 27. To this end, provision is made for a transmission 29 (not shown in detail), which is known from U.S. Pat. No. 1,991,627 and U.S. patent application Ser. No. 09/256,853, U.S. Pat. No. 6,095,066.

An X-Y table 30 (seen in detail in FIG. 2) is disposed on the base plate 2; it is mounted on guide rods 31 which extend in the X direction and it is displaceable in this direction. By means of connecting rods 32, the guide rods 31 are supported on rods 33 which are mounted in the base plate 2 and extend in the X direction. The connecting rods 32 cooperate with the rods 33 and the guide rods 31 and the table 30 to form a parallel rod guide, by means of which the table 30 can be displaced parallel to itself in the Y direction. In doing so, it makes slight motions in the Z direction which are however negligible because of their minor significance. The described motion of displacement of the table in the Y direction takes place by means of a stepper motor 34 which is coupled with one of the rods 33 via a pinion 35 and a segment gear 36. Displacement of the table 30 in the X direction takes place by means of a stepper motor 37 and a spindle drive 38 (roughly outlined). The described design and the actuation of the table 30 are also known from U.S. Ser. No. 09/256,853, U.S. Pat. No. 6,095,066. A clamp 39 is disposed on the table 30, fixing the workpiece 40. A workpiece cutter 41 for cutting a buttonhole is customarily provided beside the needle bar 8 on the arm 4 above the table 30.

Figure 5:
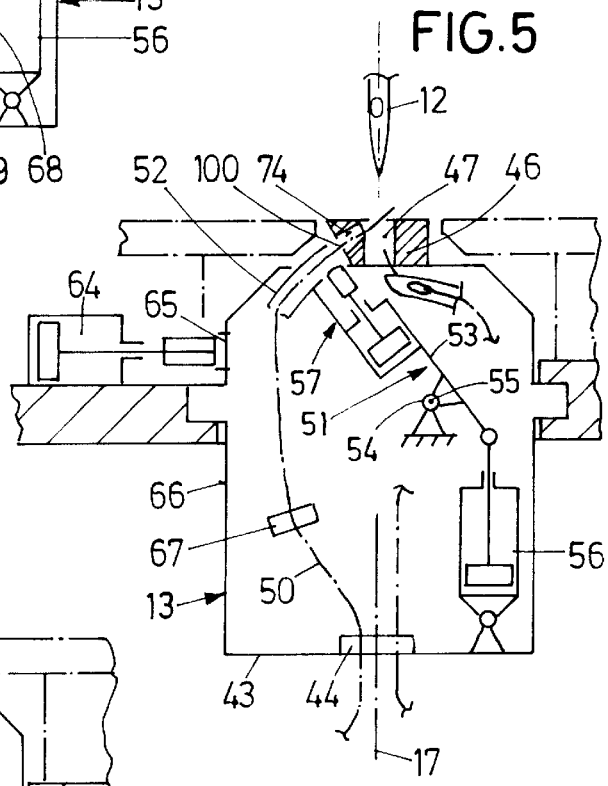
FIG. 5 is an illustration of the gimp thread feeder according to FIG. 3 during the feed of a gimp thread prior to the start of a sewing job.
Figure 4:
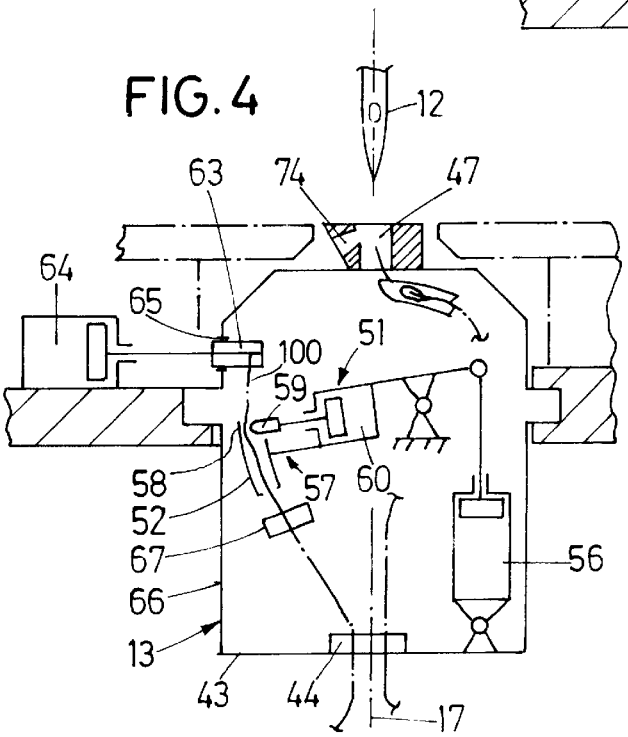
FIG. 4 is an illustration of the gimp thread feeder according to FIG. 3 during the cutting of a gimp thread.

As seen in FIGS. 3 to 5, the chain stitch hook 14 is disposed in the hook bearing 13; a looper thread 45 is fed to the hook 14 through an opening 44 formed in the bottom 43 of the hook bearing 13 concentrically of the pivot axis 17. Disposed on the base plate 2 above the hook bearing 13 and in the plane of the table 30 is a stitch plate 46 with a stitch hole 47, through which passes the needle 12 with a needle thread 48, the needle thread 48 being seized by the jogging hook 14 and a double thread chain stitch being formed in the workpiece 40.

Further provided in the hook bearing 13 is a feeder 49, feeding a gimp thread 50 to the workpiece 40 through the stitch hole 47. This feeder 49 comprises a pivotal guide 51 for the gimp thread 50. This guide 51 has a curved guide tube 52 which is mounted on a two-armed pivoted lever 53. The lever 53 is mounted in a bearing 54 pivotally about a horizontal axis 55 which extends in the X direction; the bearing 54 is disposed in the hook bearing 13. At the end, turned away from the guide tube 52, of the pivoted lever 53, a pivot drive 56 acts thereon, which is formed by a pneumatically actuated double action piston-cylinder drive articulated to the bottom 43 of the hook bearing 13. A clamping device 57 is provided on the pivoted lever 53 in a manner allocated to guide tube 52; the clamping device 57 comprises a clamping surface 58, which is formed on the guide tube 52, a clamping jaw 59, which cooperates therewith, and a clamping jaw drive 60 of linear action. The drive 60 is also formed by a pneumatically actuated double action piston-cylinder drive.

Provided on an inside wall 61 of the base plate 2, which also carries the upper bearing 15 of the hook bearing 13, is a gimp thread cutter 62, which comprises scissors 63, which are moved by means of a linear displacement drive 64 into a position of rest (seen in FIGS. 3 and 5) outside the hook bearing 13, or which are moved into the wall 66 of the hook bearing 13 through an opening 65 thereof, into a position of work (seen in FIG. 4) located in the path of the gimp thread 50. Also the displacement drive 64 is formed by a pneumatically actuated double action piston-cylinder drive.

The gimp thread 50 is supplied in the same way as the looper thread 45 through the opening 44 in the bottom 43 of the hook bearing 13 and piloted through a gimp thread guide 67 which is stationary in the hook bearing 13 and disposed on the path between the opening 44 and the guide tube 52. The pivot drive 56 and the clamping jaw drive 60 are provided with compressed air via compressed air lines 68, 69, 70, 71, which are flexible hose lines, leading through the opening 44 in the bottom 43 of the hook bearing 13. Since the hook bearing 13 only performs a non-revolving pivotal motion, flexible plastic hoses are able to participate in this motion without being damaged. The displacement drive 64 is supplied with compressed air via compressed air lines 72, 73. The scissors 63 are designed in known manner to perform a cutting motion upon advance into its position of cutting. A feed channel 74 for the gimp thread is formed in the stitch plate 46 and opens laterally into the stitch hole 47; it is located in the feed path of the guide 51.

Figure 6:
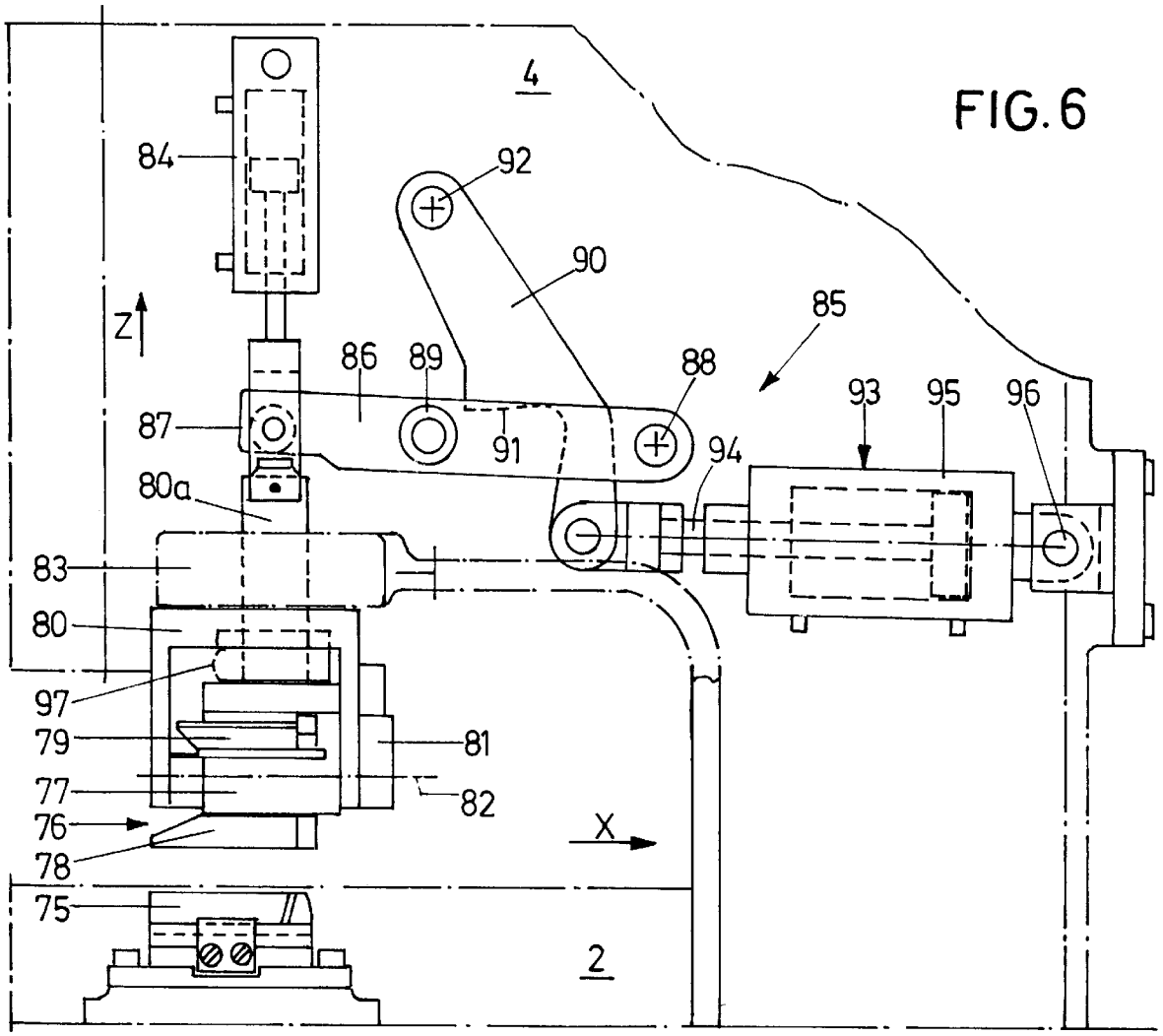
FIG. 6 is a view of a cutter on an enlarged scale as compared to FIG. 1.

The cutter 41 is known partially from U.S. Ser. No. 09/063,965, U.S. Pat. No. 6,006,685. It comprises a lower knife 75, which is located in the plane of the stitch plate 46 and is stationary in the base plate 2, and a cutting block 76 located on the arm 4 beside the needle bar 8 and vertically above the knife 75. The cutting block 76 comprises a carrier 77, on which are disposed several knife abutments 78, 79, only two of which are illustrated. The carrier 77 is rotatably mounted in a holder 80, which is designed as a downwardly open bow, and it is drivable to rotate about an axis of rotation 82 by means of a rotary actuator 81 so that one knife abutment 78 and 79 at a time moves into a position allocated to the knife 75. The holder 80 is non-rotatably, but axially displaceably arranged on a rod 80*a*, the lower end of which rests on the carrier 77. The rod 80*a* is displaceable in the Z direction, but is mounted non-rotatably in a bearing 83. A lifting mechanism 84 of vertical action, i.e. which acts in the Z direction and is designed in the form of a pneumatically actuated double action piston-cylinder drive, acts on the upper end of the rod 80*a*. Further, a cutting drive arrangement 85 acts on the rod 80*a*; it comprises a lever 86 of substantially horizontal arrangement, one end 87 of which is articulated to the holder 80 and the other end of which is mounted in the arm 4 pivotally about a horizontal axis by means of a pivot bearing 88. A roll 89 is attached to the lever 86 and can be engaged with a cam 91 formed on an operating lever. This operating lever 90 is mounted pivotally in a pivot bearing 92 in the arm 4, pivoting about an axis that is parallel to the axis of the pivot bearing 88. A cutting drive 93 in the form of a pneumatically actuated piston-cylinder drive acts on the end of the operating lever 90 that is opposite the pivot bearing 92, the piston rod 94 of this drive 93 being articulated to the end of the operating lever 90 that is opposite the pivot bearing 92. The cylinder 95 of the cutting drive is articulated by means of a bearing 96 in the arm 4. The cam 91 on the operating lever 90 is formed in such a way that it engages with the roll 89 only after a certain motion of extraction of the cutting drive 93 and then forces the cutting drive 93 downwards and thus also the holder 80 together with the carrier 77 and the knife abutments 78, 79, the downward knife abutment 78, which is located above the cutting block 76, bearing there-against. When the piston rod 94 is completely retracted into the cylinder 95—as seen in FIG. 6—then the holder 80 together with the knife abutments 78 can be lifted further upwards by means of the lifting mechanism 84 against the force of a spring 97 which is located between the holder 80 and the rod 80*a*. Only strokes in the order of magnitude of 5 mm and with a path of approximately 1 mm for the actual cutting job are performed at high forces by means of the cutting drive arrangement 85.

The knife 75 has the shape of the longest possible incision to be carried out in a buttonhole, in particular in an eye type buttonhole. The knife abutments 78 only extend over the length along which an incision will really be performed in an eye type buttonhole. Wherever no knife abutment is available for the knife 75 when an incision is made, the workpiece 40 will yield laterally so that a shorter incision is made.

The feeding device 49 cooperates with the sewing tools, i.e. the needle 12 and the hook 14, and with the cutter 41, as follows:

The basis from which to proceed is a sewing operation illustrated in FIG. 3, in which zigzag stitches are made for the production of a buttonhole seam. The zigzagging configuration is produced exclusively by the needle jogging drive 23. The gimp thread 50 is fed in a known manner into the buttonhole seam. In this case, the guide 51 together with the guide tube 52 is in its position of guidance, in which it is pivoted away from the stitch plate 46 and in which the gimp thread 50 is piloted through the opening 44, the guide 67, the guide tube 52 and the feed channel 74, which discharges laterally into the stitch hole 47, and in which the gimp thread 50 is fed out of the stitch hole 47 into the zigzag seam. The clamping device 57 is opened in this case. The cutter 62 is in its retracted position of rest so that the hook bearing 13 can be rotated together with the needle 12 freely about the pivot axis 17, corresponding to the course of the seam that is to be produced. The double thread chain stitch seam is produced by cooperation of the needle 12 and the hook 14 in known manner. The course of the seam results from the displacement of the table 30 combined with the joint pivoting of the needle 12 and the hook bearing 13.

Before the end of the seam is reached, the hook bearing 13 is in a position of rest, in which the opening 65 is located in front of the scissors 63. Now the clamping jaw drive 60 is actuated such that the clamping jaw 59 is pressed against the clamping surface 58, clamping the gimp thread 50. Simultaneously the displacement drive 64 is actuated so that the scissors 63 are moved through the opening 65 into the hook bearing 13 where they cut the gimp thread 50 at a distance from the guide tube 52. Immediately afterwards, the scissors 63 are moved out of the hook bearing by corresponding reverse actuation of the displacement drive 64; the gimp thread 50 remains clamped in the clamping device 57. The moment when the gimp thread 50 is cut through is selected such that the part of the gimp thread that leads to the workpiece 40 is taken up entirely in the finished buttonhole seam, i.e. is used up. With the subsequent start of another gimp thread 50 zigzag seam, the end 75 of the gimp thread 50 which stands out from the guide tube 52 is automatically supplied to the feed channel 74 and thus to the stitch hole 47 by the pivot drive 56 being actuated in the way seen in FIG. 5. In this way, the guide tube 52 moves as far as to the stitch plate 46 and pushes the free end 100 of the gimp thread 50 upwards through the feed channel 74 and the stitch hole 47. During this feed motion, the gimp thread 50 is still clamped between the clamping jaw 59 and the clamping surface 58. When another sewing job starts, the end 100 is clamped in the zigzag seam; the clamping arrest between the clamping jaw 59 and the clamping surface 58 is released, to which end the clamping jaw drive 60 is actuated counter to the clamping motion. Then the pivot drive 56 is again actuated in such a way that the guide tube 52 is pivoted back into its initial position illustrated in FIGS. 3 and 4.

Figure 7:
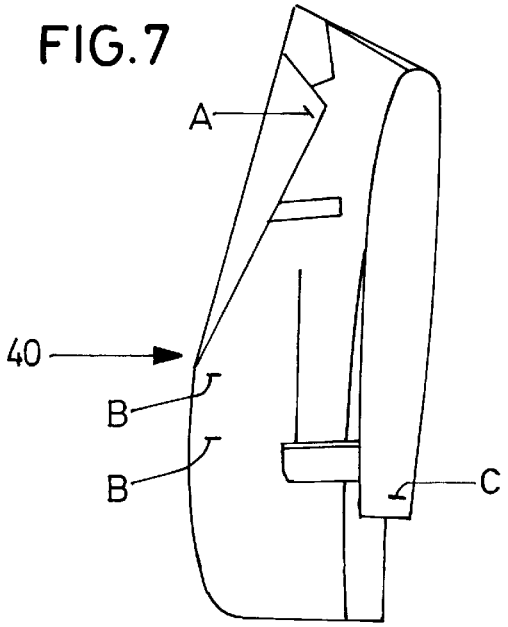
FIG. 7 is a view of a workpiece in the form of a jacket forepart comprising four buttonholes of three different types which are to be sewn.
Figure 8:
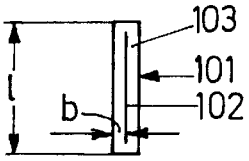
FIG. 8 is a diagrammatic illustration of a straight buttonhole.
Figure 9:
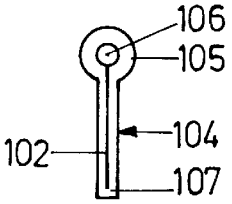
FIG. 9 is an illustration of an eye type buttonhole.
Figure 10:
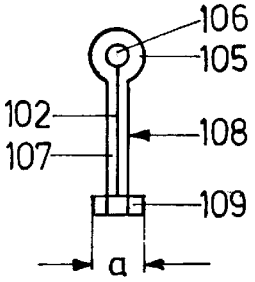
FIG. 10 is an illustration of an eye type buttonhole with a stitched transverse lock.

FIG. 7 illustrates a jacket as a workpiece 40, in which three different buttonholes are to be made, namely a lapel buttonhole A, two identical forepart buttonholes B and a sleeve buttonhole C. FIGS. 8, 9, 10 illustrate some buttonholes and the corresponding buttonhole seams only by way of example. FIG. 8 shows a simple button hole 101 without an eye, having a straight incision 102 and a rectangular zigzag seam 103. FIG. 9 illustrates a buttonhole 104 with a so-called eye 105 and a straight incision 102 and a so-called eye type incision 106 in the eye 105. In the vicinity of the eye 105, the zigzag seam 107 extends on an arc of a circle. The buttonhole 108 of FIG. 10 corresponds to that of FIG. 9, a stitched transverse lock 109 being provided in addition to the zigzag seam 107 at the end opposite the eye 105. Of course, there are lots of other forms of buttonhole seams, the illustration of which is however not necessary for the understanding of the invention. As described, the buttonholes 101, 104 and 108 are provided with different incisions 102, 102 and 106. They are produced by varying triggering/activation of the cutter 41. Of course, it is possible also to produce buttonholes without any incision as a decorative seam pattern by putting the cutter 41 out of operation in accordance with the program.

Figure 11:
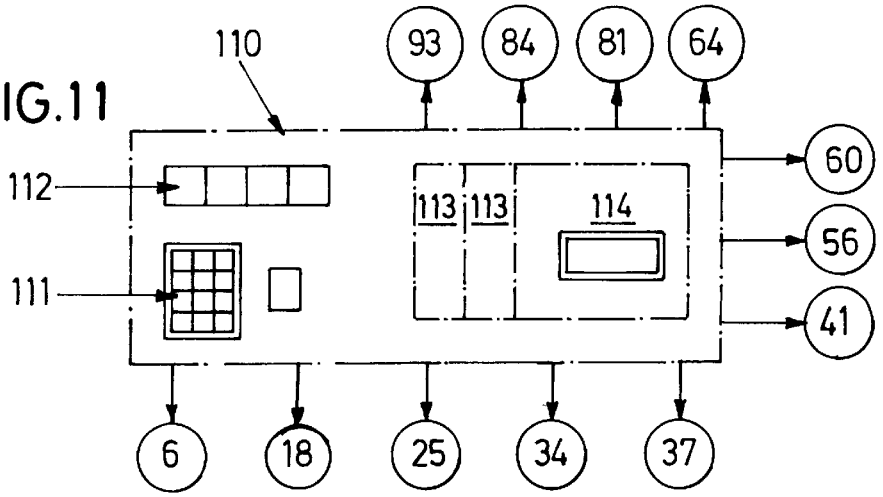
FIG. 11 is a diagrammatic illustration of an operating and control unit of the sewing machine.

The sequence of the program can be seen from FIGS. 11 and 12. The sewing machine is provided with an operating and control unit 110, into which to enter, via a keyboard, the parameters of a buttonhole 101, 104, 108, for instance the length l thereof, and the decision of whether the buttonhole is to have an eye 105 and a gimp thread 50. It is further entered whether the buttonhole is to have a straight incision 102 and an eye incision 106. Further entries involve the question whether the buttonhole is to have a stitched transverse lock 109 and what will be the width a of this transverse lock. The width b of the stitches of the respective zigzag seams 103 and 107 can also be entered. The entered data can be checked by a display 112. Further parameters of the buttonhole seams to be produced are programmable as well.

The freely selectable data are filed in working-storage sections 113 of the unit 110, whereas data relevant to the machine are filed in the main storage 114.

All the drive systems described inclusive of the drive system for the cutter 41 are triggered by the operating and control unit 110. This is roughly outlined in FIG. 11 by correspondingly encircled reference numerals. FIG. 12 diagrammatically reflects the program entry PRG described above, use being made therein of the reference numerals introduced above. The type of the workpiece 40 is entered under PRG. This is followed by the entry of the buttonholes 101, 104, 108, namely the lapel buttonhole A, the two forepart buttonholes B, B and the sleeve buttonhole C. Subsequently the respective lengths l are entered and then whether or not an eye 105 is to be sewn. In FIG. 12, the circle is marked with a diagonal cross for the corresponding feature. Then it is entered whether or not a gimp thread 50 is to be sewn in. Then it is decided whether a straight incision 102 or an eye incision 106 is to be made. Finally, it is decided whether a stitched transverse lock 109 is to be sewn and what will be the width. Finally, the width b of the zigzag seam 103 and 107 must still be entered.

What is claimed is:

1. A buttonhole sewing machine for the production of a group of buttonholes (A, B, C) on a workpiece (40), the group having at least two buttonholes (101, 104, 108) of one of varying design and size, comprising a needle (12), which is mounted in an arm (4), and which is drivable to reciprocate in a Z direction by means of a driving motor (6), which is drivable by a jogging drive (23) for the production of a zigzag seam by a motion of the needle (12) relative to the workpiece (40), and which is drivable to pivot about an axis by means of a pivot drive (18);

a hook bearing (13), which is disposed in a base plate (2), and which is drivable by a pivot drive (18) to pivot synchronously and equiangularly of the needle (12) about a pivot axis (17) which extends in the Z direction;

a hook (14), which is disposed in the hook bearing (13);

a stitch hole (47), which is allocated to the needle (12) and the hook (14);

a holder (30, 39) for the workpiece (40), which holder (30, 39) is displaceable by drives (34, 37) in an X direction and a Y direction; and an operating and control unit (110);

wherein devices are provided for the entry, storage and processing of information about at least one of the varying design and size of the group of buttonholes (A, B, C); and wherein a device is provided for triggering the drives for the successive production of the buttonholes (A, B, C) on the workpiece (40).

2. A buttonhole sewing machine according to claim 1, wherein a cutter (41) is provided for the production of an incision (102, 106) in the zigzag seam (103, 107);

wherein the operating and control unit (110) comprises means for the entry, storage and processing of information about the execution and non-execution and the type of the incision (102, 106); and wherein the device for triggering the drives also comprises means for triggering the cutter (41).

3. A buttonhole sewing machine according to claim 1, wherein a feeder (49) is provided for the supply of a gimp thread (50).

4. A buttonhole sewing machine according to claim 3, wherein the feeder (49) comprises a gimp thread guide (51), which is actuated by a drive (56).

5. A buttonhole sewing machine according to claim 3, wherein the feeder (49) comprises a clamping device (57) which is actuated by a clamping drive (60).

6. A buttonhole sewing machine according to claim 3, wherein the feeder (49) comprises a gimp thread cutter (62) which is actuated by a drive (64).

7. A buttonhole sewing machine according to claim 4, wherein the guide (51) is movable into a position of feed before the stitch hole (47) and into a position of rest remote therefrom.

8. A buttonhole sewing machine according to claim 4, wherein the drive 56) is triggered by the operating and control unit (110).

9. A buttonhole sewing machine according to claim 2, wherein the cutter (41) for the production of an incision (102, 106) comprises a knife (75), which is disposed in the base plate (2), and a cutting block (76), which is disposed in the arm (4) and which comprises several varying knife abutments (78, 79) which are movable by a rotary actuator (81) into a position opposite the knife (75).

10. A buttonhole sewing machine according to claim 5, wherein the clamping drive (60) is triggered by the operating and control unit (110).

11. A buttonhole sewing machine according to claim 6, wherein the drive (64) is triggered by the operating and control unit (110).

* * * * *